US005262929A

United States Patent [19]

Lenhart

[11] Patent Number: 5,262,929

[45] Date of Patent: Nov. 16, 1993

[54] ILLUSIONARY LIGHT APPARATUS

[76] Inventor: Michael F. Lenhart, 10487 County Rd. 4 #86, Swanton, Ohio 43558

[21] Appl. No.: 904,573

[22] Filed: Jun. 26, 1992

[51] Int. Cl.[5] ..... F21L 19/00

[52] U.S. Cl. ..... 362/161; 362/311

[58] Field of Search ..... 362/161, 163, 166, 311, 362/806, 811

[56] References Cited

U.S. PATENT DOCUMENTS

| | | | |
|---|---|---|---|
| 1,082,896 | 12/1913 | Neill | 362/161 |
| 1,883,214 | 10/1932 | Wilson et al. | 362/806 |
| 4,121,279 | 10/1978 | Whitesel | 362/811 |
| 4,139,955 | 2/1979 | Reiback | 362/811 |

*Primary Examiner*—Carroll B. Dority
*Attorney, Agent, or Firm*—Michael I. Kroll

[57] ABSTRACT

An illusionary light apparatus is provided which consists of an enclosure with at least a portion fabricated out of a one-way mirror glass and a light source is carried within the enclosure. When illumination is emitted from the light source and contacts the one-way mirror glass of the enclosure an optical illusion is created showing many light sources succeeding each other, theoretically forever, into the space beyond the light source, provided that the illumination surrounding the enclosure is less than the illumination emitted by the light source within the enclosure.

4 Claims, 2 Drawing Sheets

ILLUSIONARY LIGHT APPARATUS

BACKGROUND OF THE INVENTION

1. Field of the Invention

The instant invention relates generally to lamps and more specifically it relates to an illusionary light apparatus.

2. Description of the Prior Art

Numerous lamps have been provided in prior art that are adapted to generate light, heat or therapeutic radiation therefrom. While these units may be suitable for the particular purpose to which they address, they would not be as suitable for the purposes of the present invention as heretofore described.

SUMMARY OF THE INVENTION

A primary object of the present invention is to provide an illusionary light apparatus that will overcome the shortcomings of the prior art devices.

Another object is to provide an illusionary light apparatus in which illumination emitted from a light source within an enclosure contacts a one-way mirror glass of the enclosure to create an optical illusion showing many light sources succeeding each other into the space beyond the light source.

An additional object is to provide an illusionary light apparatus in which the light source can be of any type of light producing mechanism.

A further object is to provide an illusionary light apparatus that is simple and easy to use.

A still further object is to provide an illusionary light apparatus that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
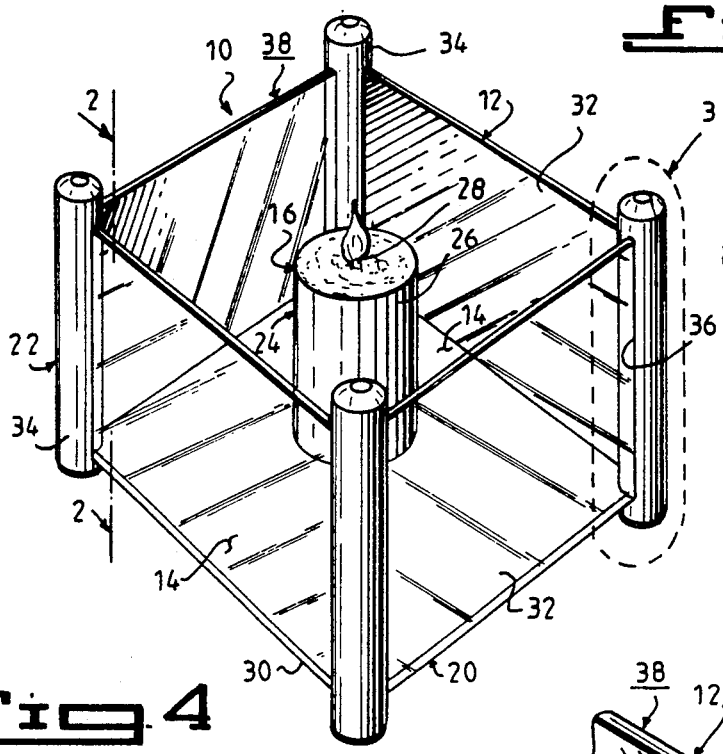
FIG. 1 is a perspective view of a first embodiment of the instant invention.
Figure 2:
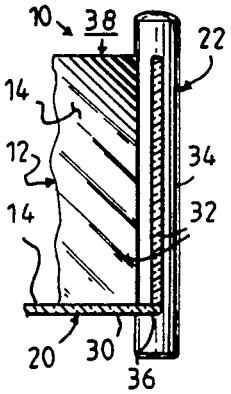
FIG. 2 is a cross sectional view taken along line 2—2 in FIG. 1 with parts broken away.
Figure 4:
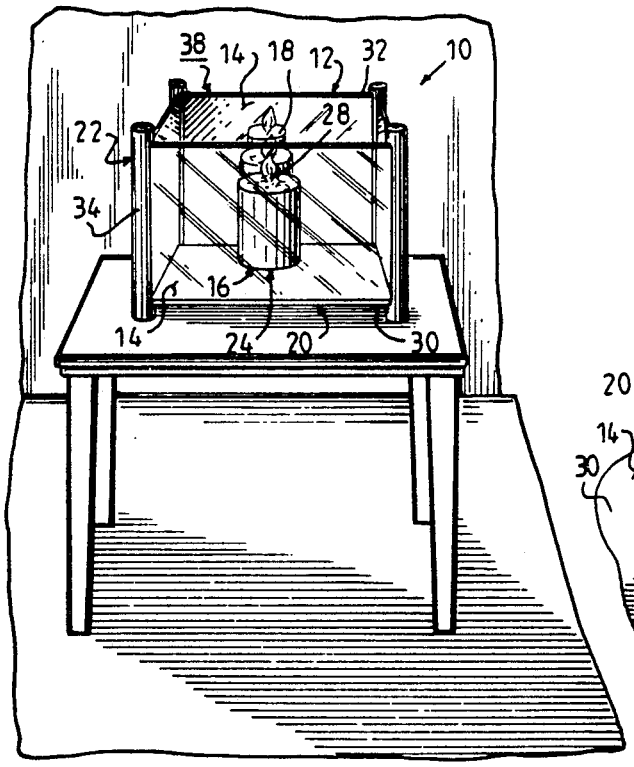
FIG. 4 is a perspective view of the first embodiment placed upon a table.
Figure 3:
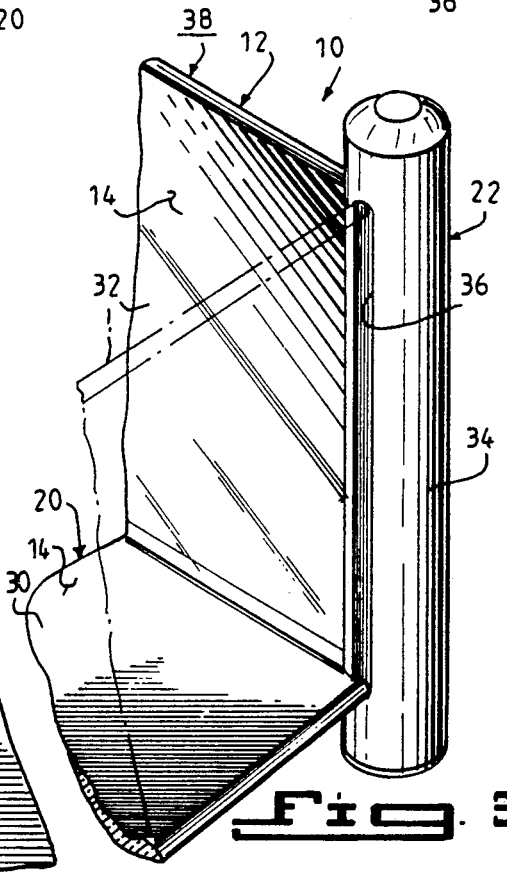
FIG. 3 is an enlarged perspective view as indicated by arrow 3 in FIG. 1, of a portion of the first embodiment showing one of the corner posts in greater detail.

Turning now descriptively to the drawings, in which similar reference characters denote similar elements throughout the several views, the Figures illustrate an illusionary light apparatus 10 which consists of an enclosure 12 with at least a portion fabricated out of a one-way mirror glass 14 and a light source 16 carried within the enclosure 12. When illumination is emitted from the light source 16 and contacts the one-way mirror glass 14 of said enclosure 12, an optical illusion 18 is created showing many light sources 16 succeeding each other, theoretically forever, into the space beyond the light source 16, provided that the illumination surrounding the enclosure 12 is less than the illumination emitted by the light source 16 within the enclosure 12.

The enclosure 12 includes a base member 20 to carry the light source 16 thereon and a side wall assembly 22 with at least a portion fabricated out of the one-way mirror glass 14 which is supported on the base member 20. The light source can be a candle 24 fabricated out of a solid, usually cylindrical mass of fatty substance 26 and an axially embedded wick 28 that is burned to provide the illumination therefrom.

As shown in FIGS. 1 through 6, the base member 20 is a bottom panel 30 fabricated out of the one-way mirror glass 14. The side wall assembly 22 includes a plurality of side panels 32, each fabricated out of the one-way mirror glass 14. A plurality of corner posts 34 are to support and secure the bottom panel 30 and the side panels 32 together to form the enclosure 12.

As shown in FIGS. 1 through 4, the enclosure 12 further includes the bottom panel 30 being rectangular shaped. The side panels 32 are four in number, with each side panel 32 being rectangular shaped. The corner posts 34 are four in number, with each corner post 34 having slots 36 formed therein. The bottom panel 30 and the side panels 32 can be inserted within the slots 36 in the corner posts 34, which when assembled together the enclosure 12 will become a rectangular shaped box 38.

Figure 5:
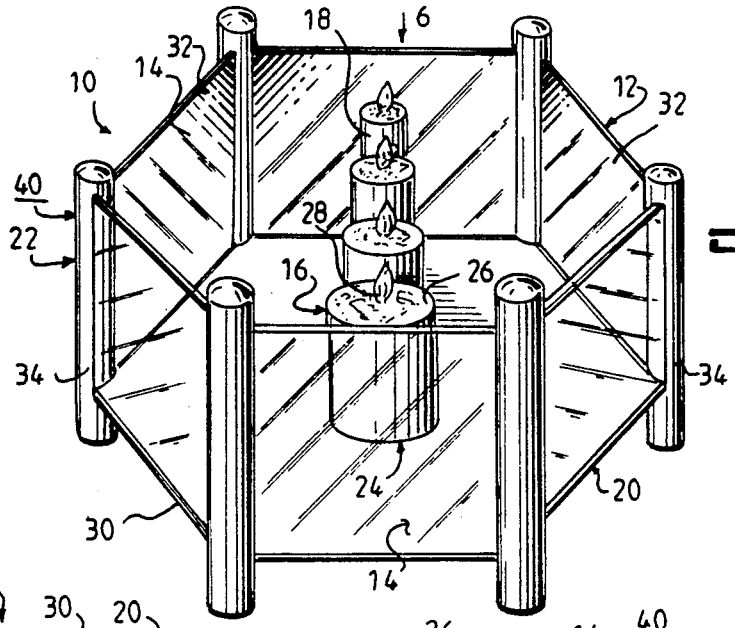
FIG. 5 is a perspective view of a second embodiment of the instant invention.
Figure 6:
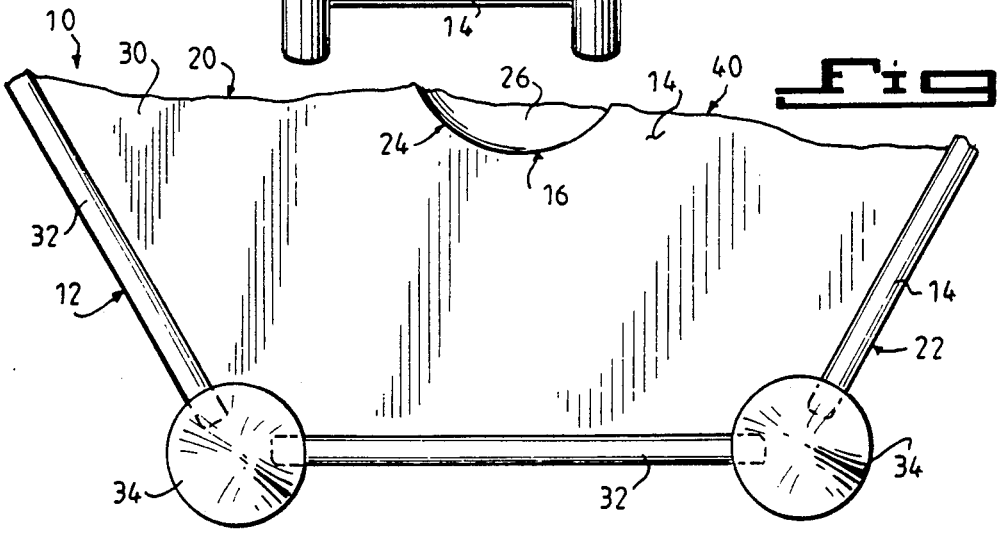
FIG. 6 is a top view taken in direction of arrow 6 in FIG. 5 with parts broken away.

As shown in FIGS. 5 and 6, the enclosure 12 further includes the bottom panel 30 being hexagon shaped. The side panels 32 are six in number, with each side panel 32 being rectangular shaped. The corner posts 34 are six in number, with each corner post 34 having slots 36 formed therein. The bottom panel 30 and the side panels 32 can be inserted within the slots 36 in the corner posts 34, which when assembled together the enclosure 12 will become a hexagon shaped box 40.

Figure 7:
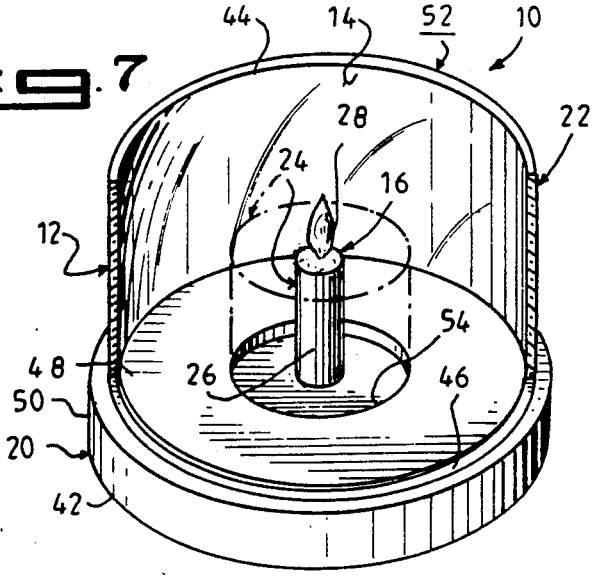
FIG. 7 is a perspective view of a third embodiment of the instant invention with parts broken away.
Figure 8:
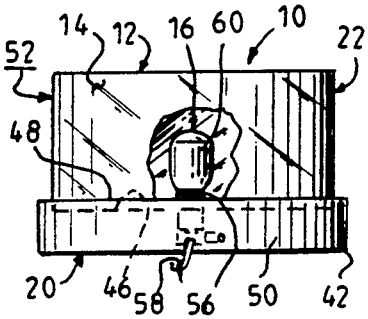
FIG. 8 is an elevational view of a fourth embodiment of the instant invention with parts broken away.

The base member 20 of the illusionary light apparatus 10, as shown in FIGS. 7 and 8, is a thick bottom platform 42 fabricated out of a durable material. The side wall assembly 22 is a continuous partition 44 fabricated out of the one-way mirror glass 14.

The enclosure 12 further includes the bottom platform 42 being circular shaped and having an annular groove 46 within the top surface 48 proximate the circumference 50 thereof. The continuous partition 44 is a tube 52 sized to fit within the annular groove 46 within the top surface 48 of the bottom platform 42.

The illusionary light apparatus 10, shown in FIG. 7, further contains the bottom platform 42 having a center circular recess 54 on the top surface 48 thereof. The light source 16 can be the candle 24 fabricated out of the solid, usually cylindrical mass of fatty substance 26 and the axially embedded wick 28 that is burned to provide the illumination therefrom. The bottom of the candle 24 can rest within the center circular recess 54 in the bottom platform 42 and be of a diameter no larger than the center circular recess 54.

The light source 16, as shown in FIG. 8, can be an electric light socket 56 mounted within the center of the top surface 48 of the bottom platform 42. An electric cord 58 is connected to the electric light socket 56 to carry electric current thereto. An electric light bulb 60 is connected to the electric light socket 56 to provide the illumination therefrom.

Other types of light sources 16 might be used, such as a high intensity fluorescent/"black" light, a neon light, a xenon light, a Lava Lite; a fiber optic light, a chemically produced light, a liquid crystal light, a projected light, a hologram and a laser light.

There are other types of candles 24, such as a liquid candle that is simply a wick floating on a fuel source (oil), which can be utilized in the illusionary light apparatus 10.

Other types of enclosures 12 might also be used, such as a lamp/lantern chimney; a hurricane lamp chimney; an enclosure made so that the front and side panels are one-way mirrors, the rear panel being a regular mirror with the enclosure fastened to a wall and an enclosure using a curved one-way mirror and a curved regular mirror.

LIST OF REFERENCE NUMBERS

10 illusionary light apparatus
12 enclosure
14 one-way mirror glass
16 light source
18 optical illusion
20 base member of 12
22 side wall assembly of 12
24 candle for 16
26 cylindrical mass of fatty substance of 24
28 wick of 24
30 bottom panel for 20
32 side panel for 22
34 corner post for 22
36 slot in 34
38 rectangular shaped box for 12
40 hexagon shaped box for 12
42 thick bottom platform for 20
44 continuous partition for 22
46 annular groove in 42
48 top surface of 42
50 circumference of 42
52 tube for 44
54 center circular recess in 48
56 electric light socket for 16
58 electric cord
60 electric light bulb It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An illusionary light apparatus which comprises:

a) an enclosure fabricated out of a one-way mirror glass, said enclosure includes a base member to carry a light source thereon, said base member is a bottom panel fabricated out of the one-way mirror glass, and a side wall assembly fabricated out of the one-way mirror glass which is supported on said base member, said side wall assembly includes a plurality of side panels, each fabricated out of the one-way mirror glass, and a plurality of solid corner posts with grooves to support and secure said bottom panel and said side panels together to form said enclosure; and b) a light source carried within said enclosure, so that when illumination is emitted from said light source and contacts the one-way mirror glass of said enclosure, an optical illusion is created showing many light sources succeeding each other, theoretically forever, into the space beyond said light source, provided that the illumination surrounding said enclosure is less than the illumination emitted by said light source within said enclosure, said light source is a candle fabricated out of a solid, usually cylindrical mass of fatty substance and an axially embedded wick that is burned to provide the illumination therefrom.

2. An illusionary light apparatus as recited in claim 1, wherein said enclosure further includes:

a) said bottom panel being rectangular shaped;

said side panels being four in number, with each said side panel being rectangular shaped; and c) said solid corner posts being four in number, with each said solid corner post having grooves formed therein, so that said bottom panel and said side panels can be inserted within the grooves in said solid corner posts, which when assembled together said enclosure will become a rectangular shaped box.

3. An illusionary light apparatus as recited in claim 2, wherein said enclosure further includes:

a) said bottom panel being hexagon shaped;

b) said side panels being six in number, with each said side panel being rectangular shaped; and c) said corner posts being six in number, with each said corner post having slots formed therein, so that said bottom panel and said side panels can be inserted within the slots in said corner posts, which when assembled together said enclosure will become a hexagon shaped box.

4. An illusionary light apparatus as recited in claim 1, wherein said base member is a thick bottom platform fabricated out of a durable material.

* * * * *